US006427424B1

(12) United States Patent
Pollock

(10) Patent No.: US 6,427,424 B1
(45) **Date of Patent: *Aug. 6, 2002**

(54) VACUUM-ASSISTED BULK PARTICULATE PACKAGING SYSTEM

(76) Inventor: John Pollock, 106 Industrial, Garnett, KS (US) 66032

( * ) Notice: Subject to any disclaimer, the term of this patent is extended or adjusted under 35 U.S.C. 154(b) by 0 days.

This patent is subject to a terminal disclaimer.

(21) Appl. No.: 09/552,384

(22) Filed: Apr. 19, 2000

Related U.S. Application Data

(63) Continuation-in-part of application No. 09/471,624, filed on Dec. 24, 1999, now Pat. No. 6,321,645.

(51) Int. Cl.[7] ..... B65B 31/00; B65B 13/20; B30B 9/00

(52) U.S. Cl. ..... 53/510; 53/529; 53/530; 100/90; 100/138; 100/140

(58) Field of Search ..... 53/510, 529, 530; 100/90, 137, 138, 139, 140, 151, 152, 215, 218, 246; 198/626.1, 612

(56) References Cited

U.S. PATENT DOCUMENTS 2,682,216 A * 6/1954 Shields ..... 100/151
3,581,876 A * 6/1971 Keith ..... 100/151
3,929,065 A * 12/1975 Csordas et al. ..... 100/90
3,971,310 A * 7/1976 Kondos et al. ..... 100/152
4,041,855 A * 8/1977 Egosi ..... 100/138
4,127,062 A * 11/1978 Egosi ..... 100/218
4,457,125 A * 7/1984 Fishburne ..... 53/510
4,572,065 A * 2/1986 Fishburne ..... 53/510
4,994,138 A * 2/1991 Prihoda ..... 100/152
5,943,846 A * 8/1999 Pollock ..... 53/529
5,979,145 A * 11/1999 Louis et al. ..... 53/529
6,003,684 A * 12/1999 Eickhoff et al. ..... 100/152
6,112,501 A * 9/2000 Pollock ..... 53/529

* cited by examiner

*Primary Examiner*—Stephen F. Gerrity
*Assistant Examiner*—Louis Huynh
(74) *Attorney, Agent, or Firm*—Dale J. Ream

(57) ABSTRACT

A system for forming particulate material in a bulk form comprises a compression tower having a top and sides depending therefrom. A compression chamber having side walls and an open bottom is reciprocatively mounted to said tower for deposit of loose particulate material therein. The system further includes a first conveyor assembly displaced from said tower. In its extended position, the chamber contacts the first conveyor assembly and the bottom of the chamber is closed thereby. A vacuum blower draws loose particulate material into the chamber through an inlet and compresses it against the first conveyor assembly. A ram assembly within the chamber further compresses the loose material into a bulk form atop the conveyor belt. When the chamber and ram assembly are returned to their retracted positions, the material bulk is transferred downstream by the first conveyor assembly to a space between vertically spaced second and third conveyor assemblies. The downstream end of the third conveyor assembly pivots toward the downstream end of the second conveyor assembly as the material bulk is urged therebetween such that the material bulk is again compressed between the downstream ends.

5 Claims, 17 Drawing Sheets

VACUUM-ASSISTED BULK PARTICULATE PACKAGING SYSTEM

CROSS REFERENCE TO RELATED APPLICATION

This application is a continuation-in-part of application Ser. No. 09/471,624 filed on Dec. 24, 1999 now U.S. Pat. No. 6,321,645 granted Nov. 27, 2001.

BACKGROUND OF THE INVENTION

The present invention relates generally to a particulate material densification system and, more particularly, to a vacuum-assisted system for forming bulk particulate material into a desired bulk form with minimal fibrous lumps and transferring the bulk material downstream for packaging.

Various devices have been proposed for shaping and packaging particulate material into a bulk form. Certain devices first compress the material into a bulk form and ram-direct the bulk into a preformed plastic bag. One problem with these devices is that the movement of the material bulk from one station to the other dislodges portions of the material from the previously shaped bulk, particularly at the corners thereof. This material separation can occur during ram induced transport particularly when directed through a downstream chamber such that friction arises. The resulting friction dislodges particulates from the material bulk, particularly at the corners thereof and forms fibrous lumps of material. Fibrous lumps in the particulate material cause an uneven material bulk, which precludes easy palletization and unnecessary waste of the particulate material.

While the packaging system shown in U.S. Pat. No. 5,943,846, granted to this inventor, solves many of the above mentioned problems, a system which provides an optimally densified material bulk which minimizes or even precludes fibrous lumps therein is still needed.

SUMMARY OF THE INVENTION

In response thereto, the present invention provides a system for vacuum-assisted densification of particulate material which comprises a vertical compression tower having walls and a top. A compression chamber having a series of sides and open upper and lower ends is reciprocatively mounted to the tower with piston/cylinder assemblies. A ram assembly is mounted to the top of the tower and extends downwardly through the chamber. The ram assembly includes a piston/cylinder assembly having a compression plate attached to a rod thereof for extension through the chamber.

The system also includes a conveyor assembly positioned below the tower and having a perforated conveyor belt extending thereabout. The chamber is selectably extendable between a first position displaced from the conveyor assembly and a second position adjacent the conveyor assembly. The conveyor assembly includes an air chamber that is coupled to a vacuum blower such that air within the chamber may be evacuated through the perforated conveyor belt when the chamber is in the second position.

Accordingly, particulate material can be drawn into the compression chamber and onto the conveyor belt when the compression chamber is lowered to its second position. As air is withdrawn therefrom through the perforated conveyor belt, the particulate material is compressed into bulk form upon the conveyor belt. The ram assembly is then extended to further compress the particulate material into bulk form.

The chamber then returns to a position displaced from the conveyor assembly and an operation of the conveyor assembly conveys the bulk to a downstream recompression assembly.

The recompression assembly includes a second conveyor assembly horizontally adjacent the first conveyor assembly for receiving the material bulk. A third conveyor assembly is vertically displaced from the second conveyor assembly and material bulk. The third conveyor assembly pivots as the bulk is conveyed downstream by the second conveyor assembly such that the downstream ends of the second and third conveyors converge a predetermined amount to again compress the bulk. The material bulk is conveyed into a bag immediately upon recompression.

The second and third conveyor assemblies each include a conveyor belt having a fixed length which operates in a downstream direction for urging the material bulk downstream and then operates in an upstream direction before receiving another bulk from the first conveyor assembly. Accordingly, the inefficient or inaccurate tracking common to continuous conveyor belts is minimized or even precluded.

Therefore, it is a general object of this invention to provide a system for compressing particulate material into bulk form which uses negative air pressure to draw particulate material into a compression chamber.

Another object of this invention is to provide a system, as aforesaid, which utilizes a reciprocating compression chamber and a reciprocating ram assembly.

Still another object of this invention is to provide a system, as aforesaid, in which the open lower end of the compression chamber is closed upon lowering the chamber to bear against a conveyor assembly.

Yet another object of this invention is to provide a system, as aforesaid, which first compresses particulate material by evacuating air from the compression chamber.

A still further object of this invention is to provide a system, as aforesaid, which evacuates air from the air chamber through a perforated conveyor belt.

A particular object of this invention is to provide a system, as aforesaid, which diminishes the separation of the particulate material from the material bulk.

Another particular object of this invention is to provide a system, as aforesaid, which diminishes the production of fibrous lumps in the material bulk.

A further object of this invention is to provide a system, as aforesaid, in which the compression chamber retracts from the conveyor assembly after a material bulk is compressed by the ram assembly.

A still further object of this invention is to provide a system, as aforesaid, wherein the height of the material bulk can be regulated thereby providing for packaging weight modifications without deviance from the optimum length and width requirements necessary for palletization.

Another object of this invention is to provide a system, as aforesaid, which recompresses the material bulk as the material bulk is conveyed downstream of the compression chamber for packaging.

Still another object of this invention is to provide a system, as aforesaid, having a pair of conveyor assemblies which incrementally recompresses the material bulk as it is conveyed downstream of the compression chamber.

Yet another object of this invention is to provide a system, as aforesaid, in which the pair of recompression conveyor assemblies include non-continuous conveyor belts.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

The preferred embodiment of the vacuum-assisted particulate material densification system will now be described with reference to FIGS. 1–17 of the accompanying drawings.

Figure 1:
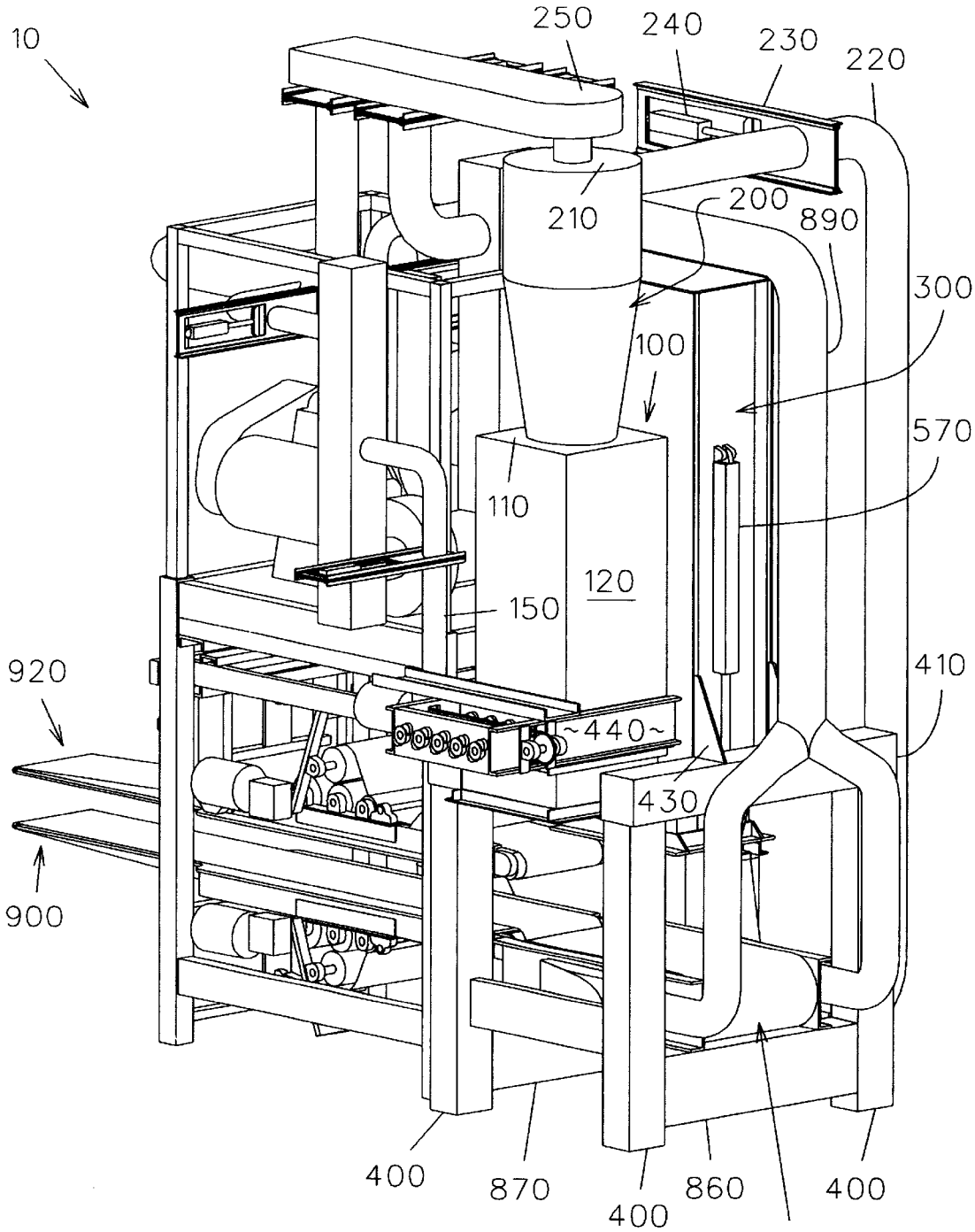
FIG. 1 is a perspective view of the vacuum assisted particulate densification system according to the present invention.

The system 10 according to the invention generally comprises a compression tower 300 for forming loose particulate material into bulk form 12 and a feed hopper 100 for preparing the loose particulate material for deposit into the compression tower 300. The feed hopper 100 is a box-like structure comprising a top wall 110 with vertical side walls 120 depending therefrom and a bottom wall (FIG. 1). A funnel-like structure or cyclone 200 having a closed top 210 and an open bottom is mounted atop the feed hopper 100. The top wall 210 of the feed hopper 100 includes an aperture having a diameter corresponding to the diameter of the open bottom of the cyclone such that particulate matter may be drawn from the cyclone 200 into the hopper 100, as to be further described below.

Figure 2:
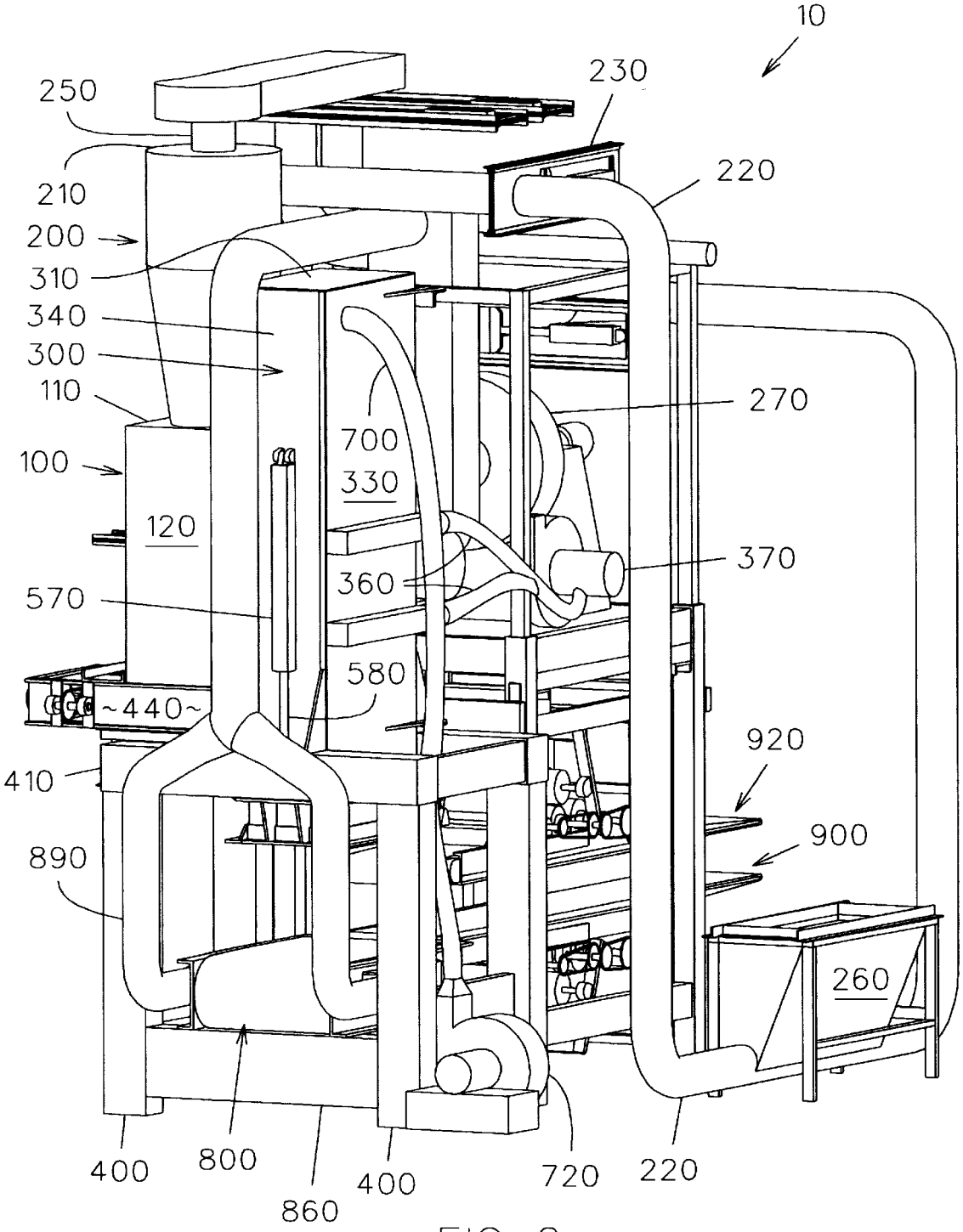
FIG. 2 is a rear perspective view of the system of FIG. 1 with the compression chamber in a retracted position.

An upstream portion 220 of a first conduit connects the cyclone 200 with a surge bin 260 containing loose particulate material (FIG. 2). A downstream portion 250 of the first conduit connects the top 210 of the cyclone 200 with a first vacuum-type blower 270. An operation of the first blower 270 causes loose particulate material to be drawn through the upstream portion 220 of the first conduit into the cyclone 200. A gate 230 having a piston/cylinder combination 240 is coupled to the upstream portion 220 of the conduit for selectably controlling the flow of air therethrough. It should also be appreciated that the upstream portion 220 of the first conduit connects to the cyclone 200 at an angle such that the particulate material is circulated or swirled therein to prevent fibrous lumps from forming.

Figure 12:
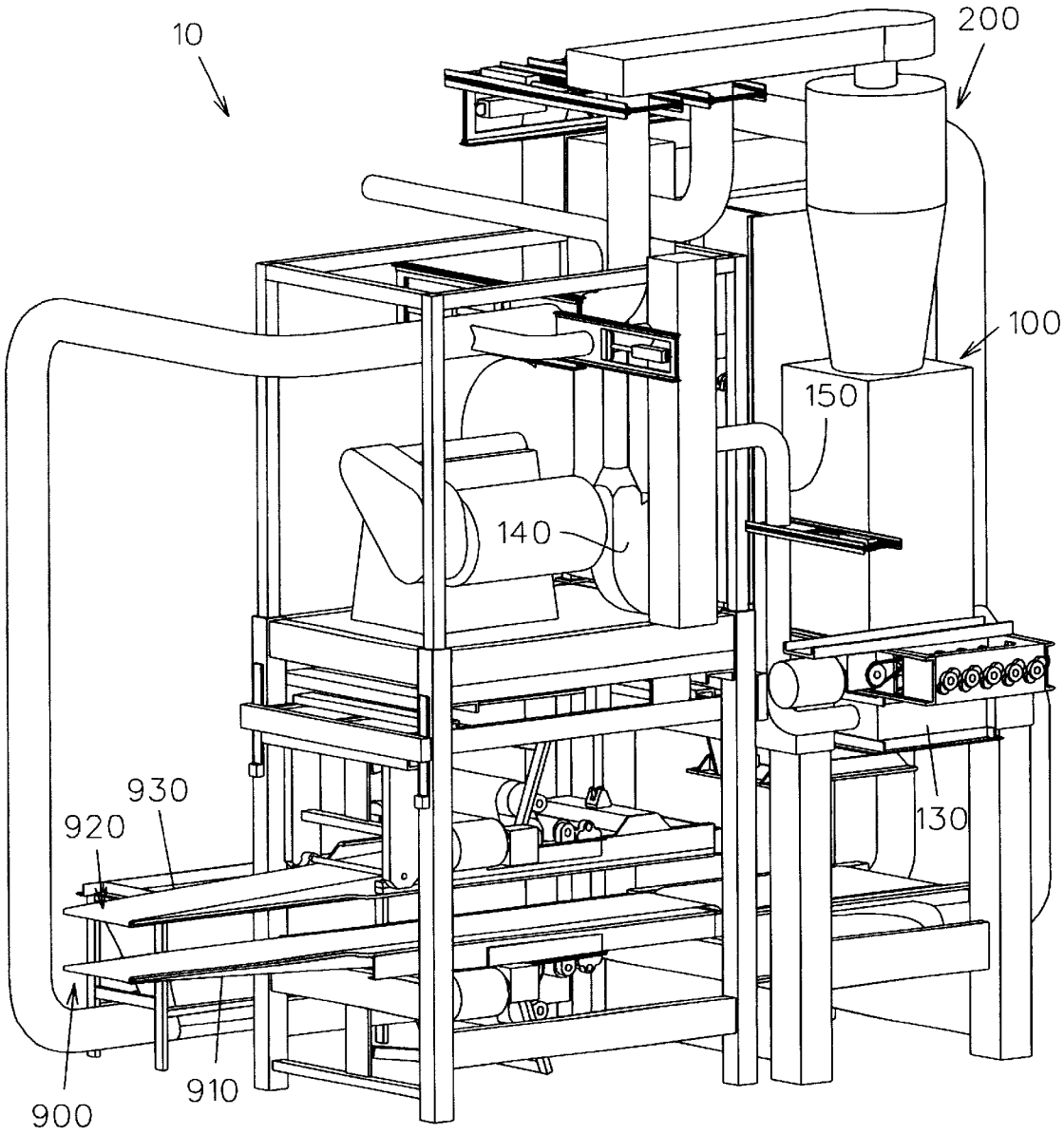
FIG. 12 is another perspective view of the system of FIG. 1.
Figure 13:
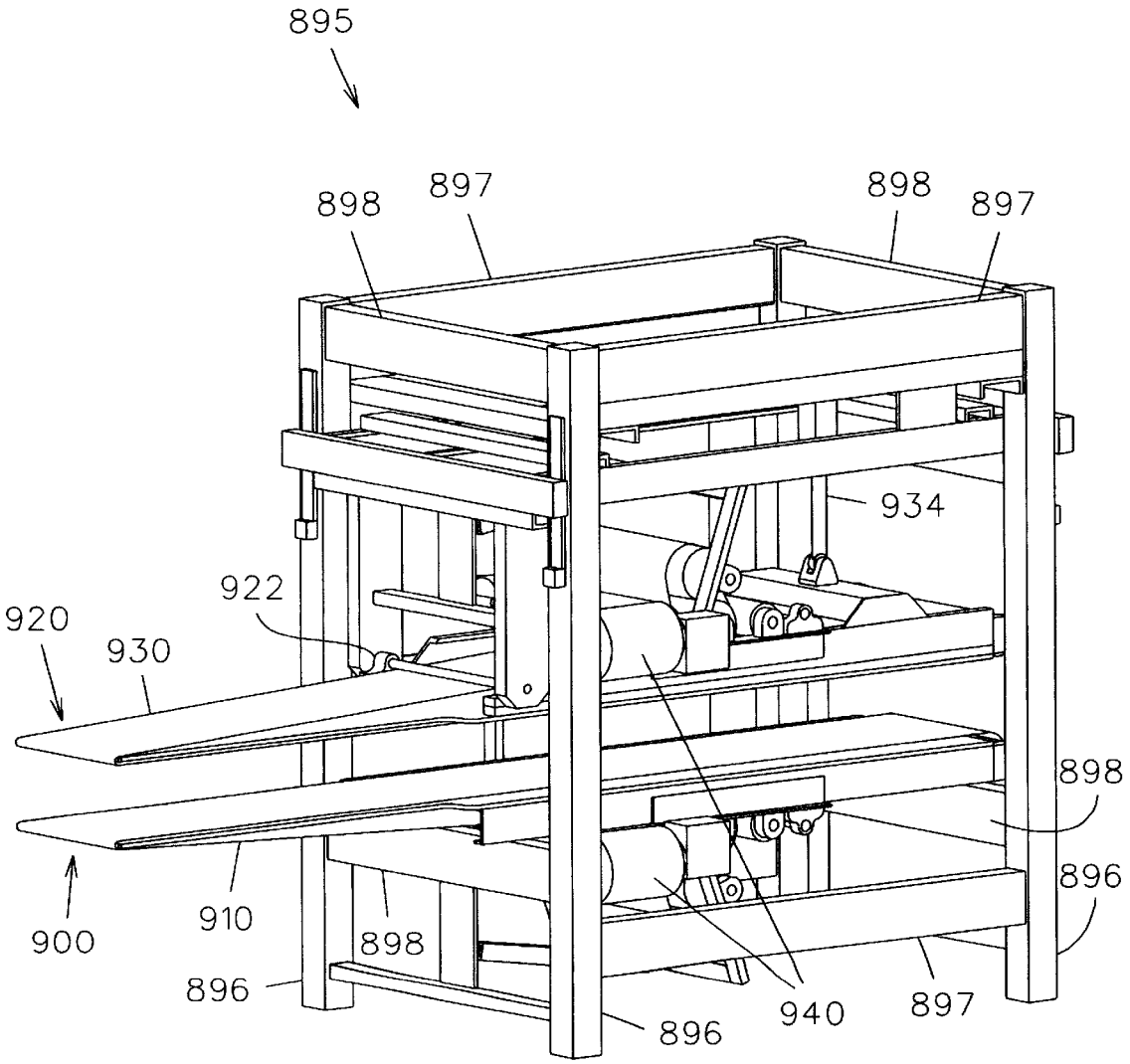
FIG. 13 is a perspective view of the downstream conveyance apparatus removed from the densification system.
Figure 14:
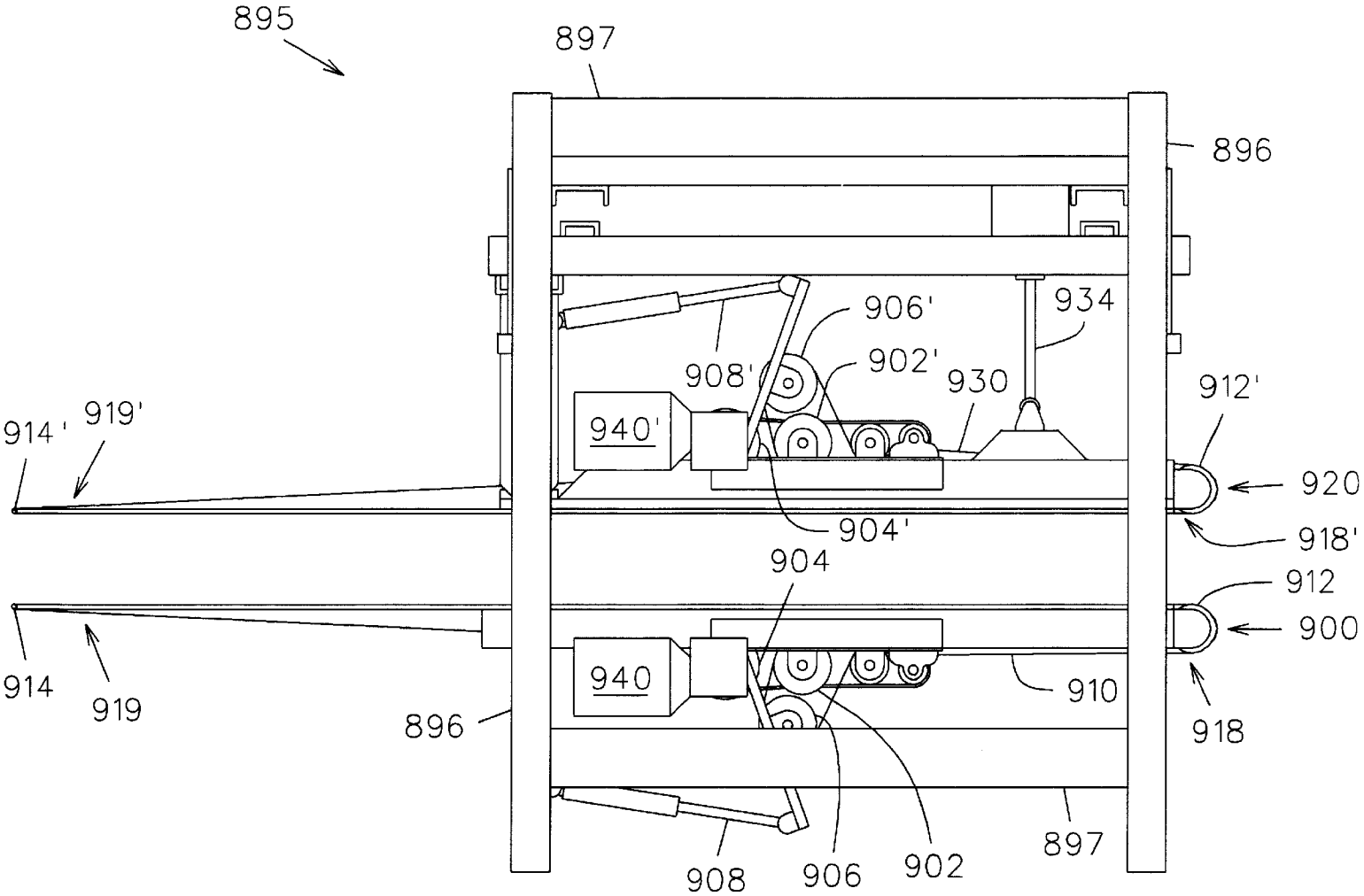
FIG. 14 is a side view of the apparatus of FIG. 13 with the second conveyor assembly in a first position.

The feed hopper 100 includes an air chamber 130 coupled to a second vacuum-type blower 140 with a conduit 150 (FIG. 12). An operation of the second blower 140 causes air to be evacuated from the feed hopper 100. This evacuation of air from the feed hopper 100 yields a negative air pressure therein such that particulate material is drawn from the cyclone 200 into the hopper 100.

The compression tower 300 comprises a top wall 310, vertical front 320 and rear 330 walls with side walls 340 therebetween, and an open bottom. The rear wall 330 is pivotally attached to a side wall 340 such that the rear wall may be selectively opened to provide access therein. The rear wall 330 also includes a series of apertures 350 coupled to conduits 360, the conduits 360 being connected to a third vacuum-type blower 370 for selectably evacuating air from the tower 300 (FIG. 2), as to be described more fully below. The tower 300 is supported by a framework which comprises a plurality of vertical legs 400 with side cross struts 410, 420 extending therebetween. The tower 300 includes support plates 430 which rest upon the cross struts 410, 420 and are fixedly attached thereto (FIGS. 1 and 12). The feed hopper 100 is fixedly attached to the tower 300 with support braces 440.

Figure 3:
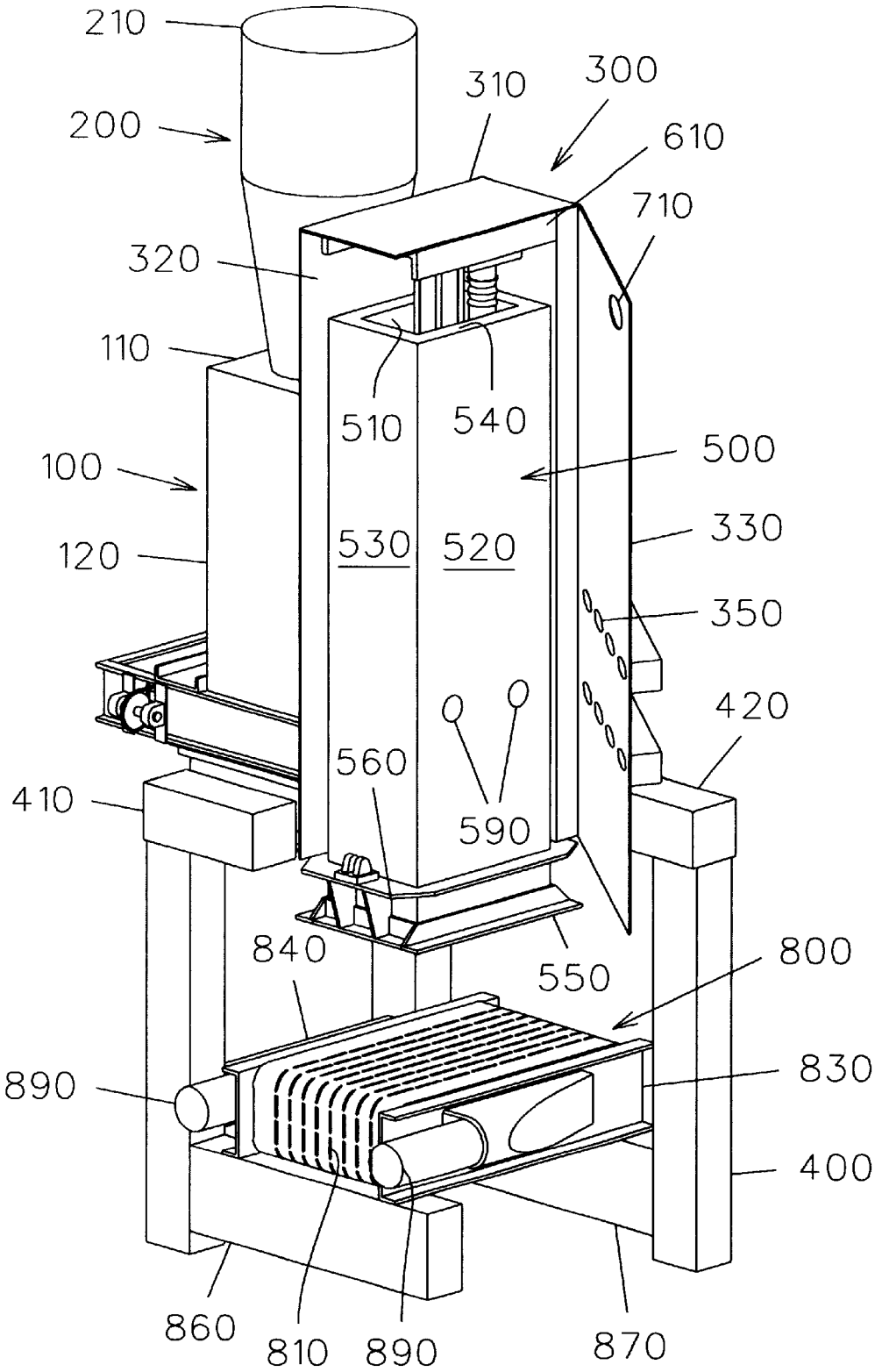
FIG. 3 is a partial perspective view of the system of FIG. 2 with portions of the tower and conduit removed.
Figure 4:
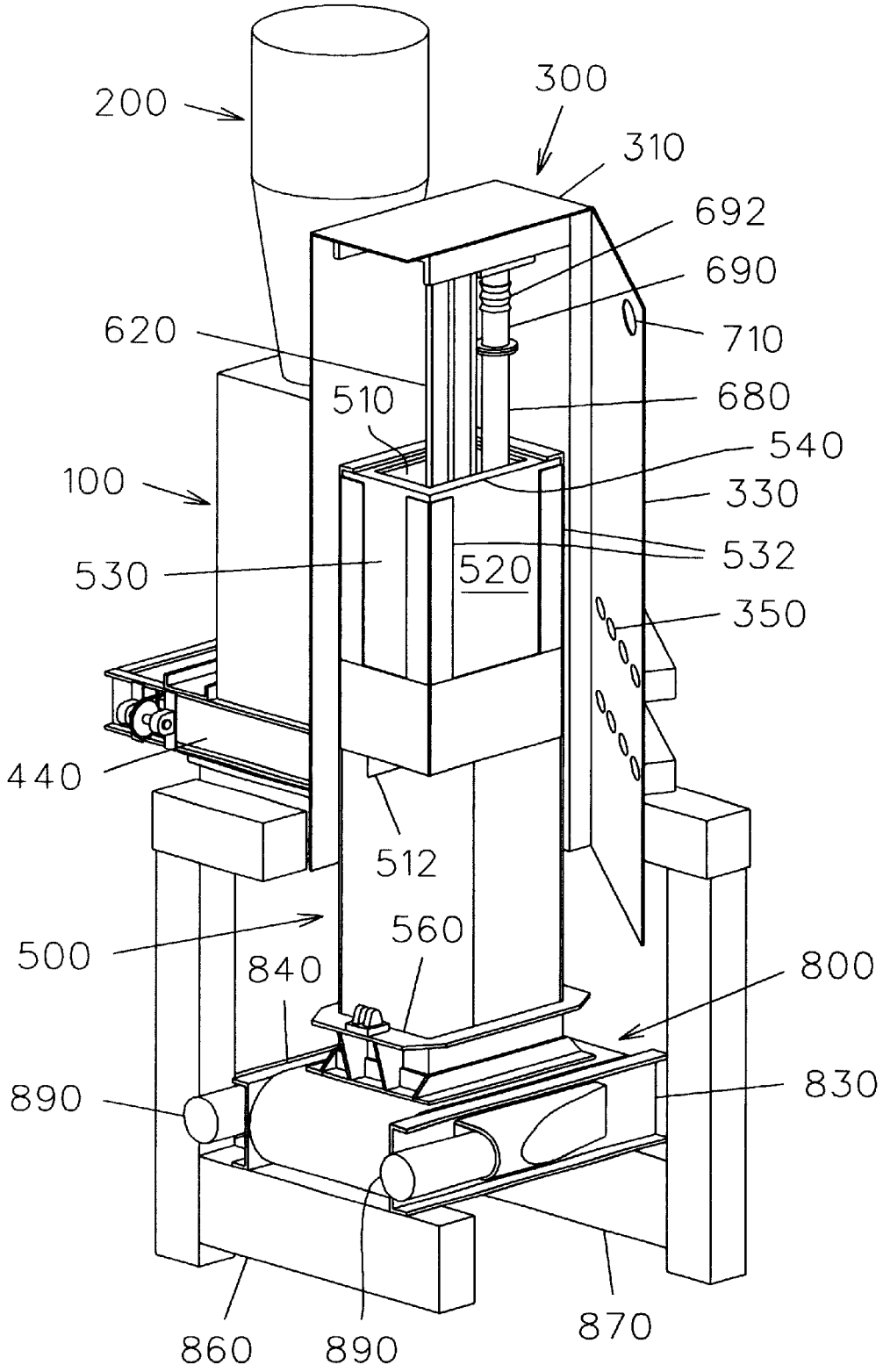
FIG. 4 is perspective view as in FIG. 3 with a portion of the compression chamber removed and the chamber in an extended position.
Figure 5:
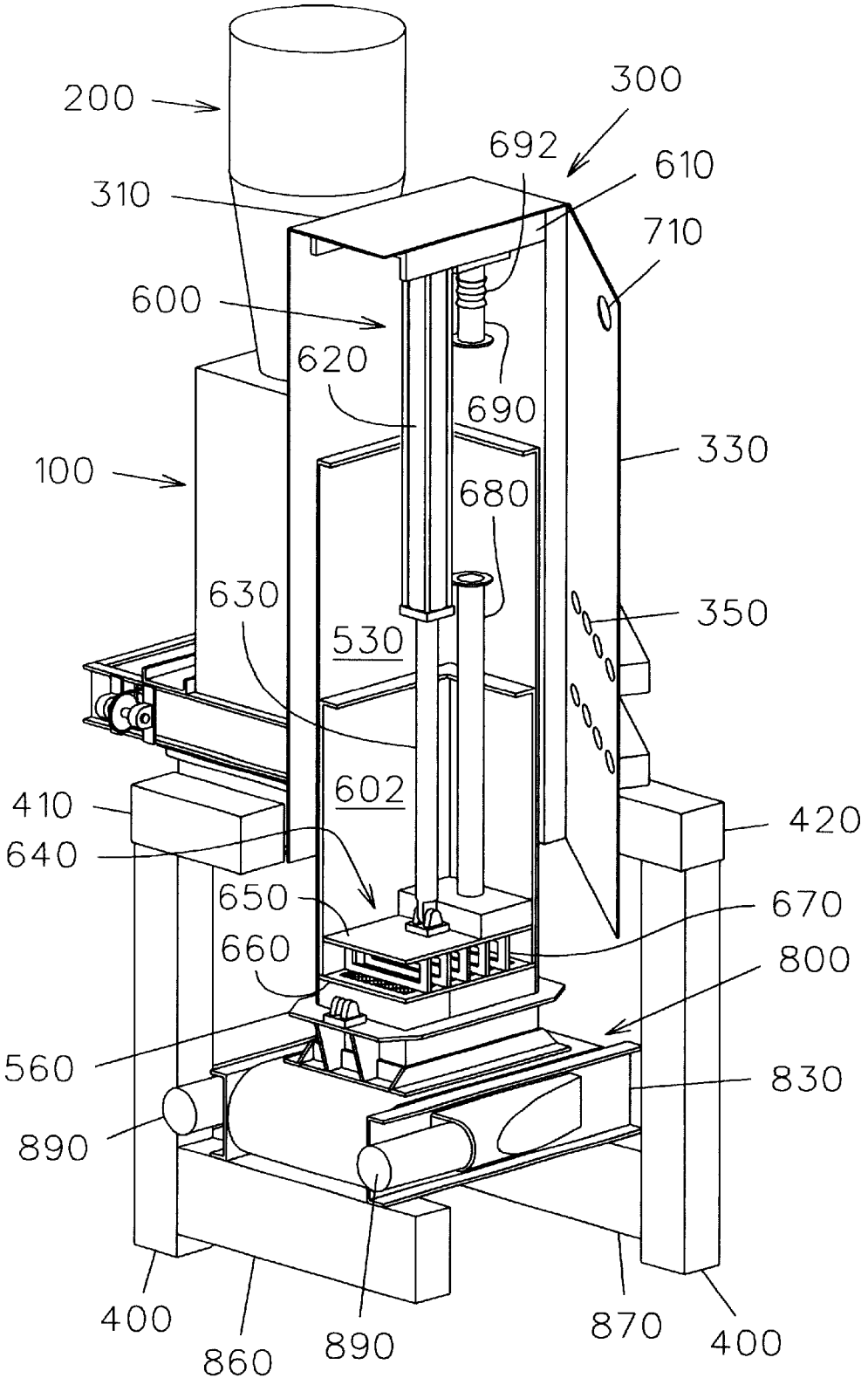
FIG. 5 is a perspective view as in FIG. 4 with an entire front and side wall removed.

Within the tower 300 is a compression chamber 500 having upstanding front 510 and rear 520 walls with side walls 530 extending therebetween (FIGS. 3–5). The upper 540 and lower 550 ends of the chamber 500 are open. A mounting plate 560 extends outwardly about the periphery of the chamber 500 adjacent the lower end 550 thereof. Piston/cylinder combinations 570 are mounted to the outer surfaces of the side walls 340 of the tower 300. Each piston/cylinder combination 570 includes a rod 580, the free end of which is fixedly attached to the mounting plate 560 of the chamber 500 such that the chamber 500 is reciprocatively movable between a first position in which the mounting plate 560 is adjacent a lower end of the tower 300 and a second position in which the lower end 550 of the chamber 500 is displaced from the lower end of the tower 300. The rear wall 520 includes a pair of apertures 590 which momentarily register with the tower apertures 350 when the chamber 500 is moving between the second extended position and the first retracted position whereby airborne particles are vacuumed from the chamber 500. Wear plates 532 extend along the edges of the walls of the chamber 500.

Particulate material may be transferred from the hopper 100 into the compression chamber 500 through openings in the walls thereof. An outlet is formed in one side wall 120 of the hopper 100. An inlet is formed in a side wall of the compression tower 300, the tower inlet registering with the hopper outlet and having a configuration that is substantially similar thereto. An inlet 512 is formed in one of the side walls 530 of the compression chamber 500 and registers with the inlet in the compression tower 300 when the compression chamber 500 is in its second lowered position and the ram assembly 600 is in a raised position, as shown in FIG. 4 and as to be further described below.

Within the tower 300 is a mounting plate 610 adjacent the top wall 310 with a piston/cylinder combination 620 depending therefrom and extending through the open top of the compression chamber 500 (FIGS. 3–5). A compression assembly 640 is attached to the free bracketed end of the reciprocating rod 630 of the piston/cylinder combination 620, the compression assembly 640 having a configuration generally congruent to the lower open end of the compression chamber 500. The piston rod 630 is reciprocatively extendable between a first retracted position in which the compression assembly 640 is upwardly displaced from the lower end 550 of the chamber 500 (FIG. 3) and a second extended position in which the compression assembly 640 is substantially adjacent the lower end 550 of the chamber 500 (FIG. 4).

The compression assembly 640 is a box-like structure having side walls 602 and an open upper end and a lower end. The lower end comprises a top plate 650 and a porous bottom plate 660 with a series of upstanding support plates 670 intermediate the top 650 and bottom 660 plates (FIG. 5). A lower portion 680 of a conduit is in communication with the space between the top 650 and bottom 660 plates and extends upwardly therefrom. An upper portion 690 of the conduit extends downwardly from the top wall 310 of the tower 300 and is connected to the first blower 270. The upper portion 690 includes a flexible segment 692. The upper 690 and lower 680 portions of the conduit register when the ram assembly 600 is in a retracted position such that air is evacuated from the chamber 500. Further, air is free to escape through the porous bottom plate 660 and lower portion 680 of the conduit when the ram assembly 600 is extended to compress the particulate material.

After an extension of the ram assembly 600 to compress the particulate material, air is forced into the compression chamber 500 through a conduit 700 which extends from an aperture 710 in the rear wall 330 of the tower 300 to a fourth blower 720 (FIG. 2). This addition of positive air pressure into the chamber 500 aids separation of the compression assembly 640 from the compressed material bulk.

Figure 6:
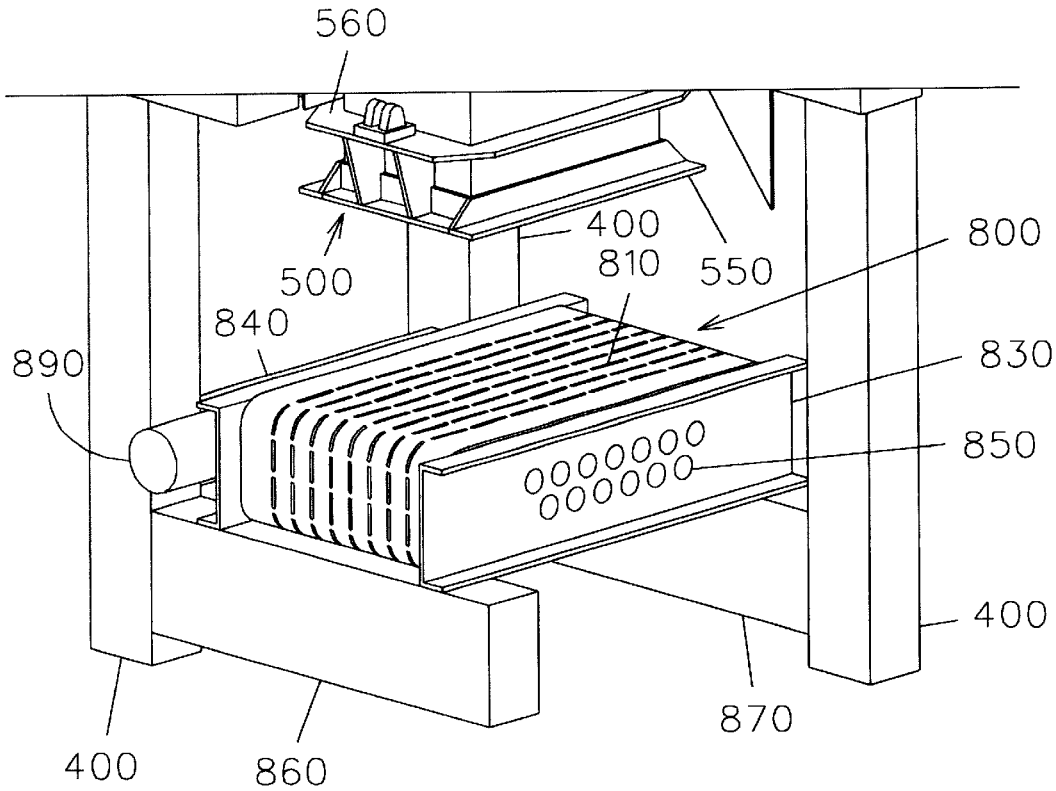
FIG. 6 is a fragmentary view on an enlarged scale of the compression chamber in a retracted position.
Figure 7:
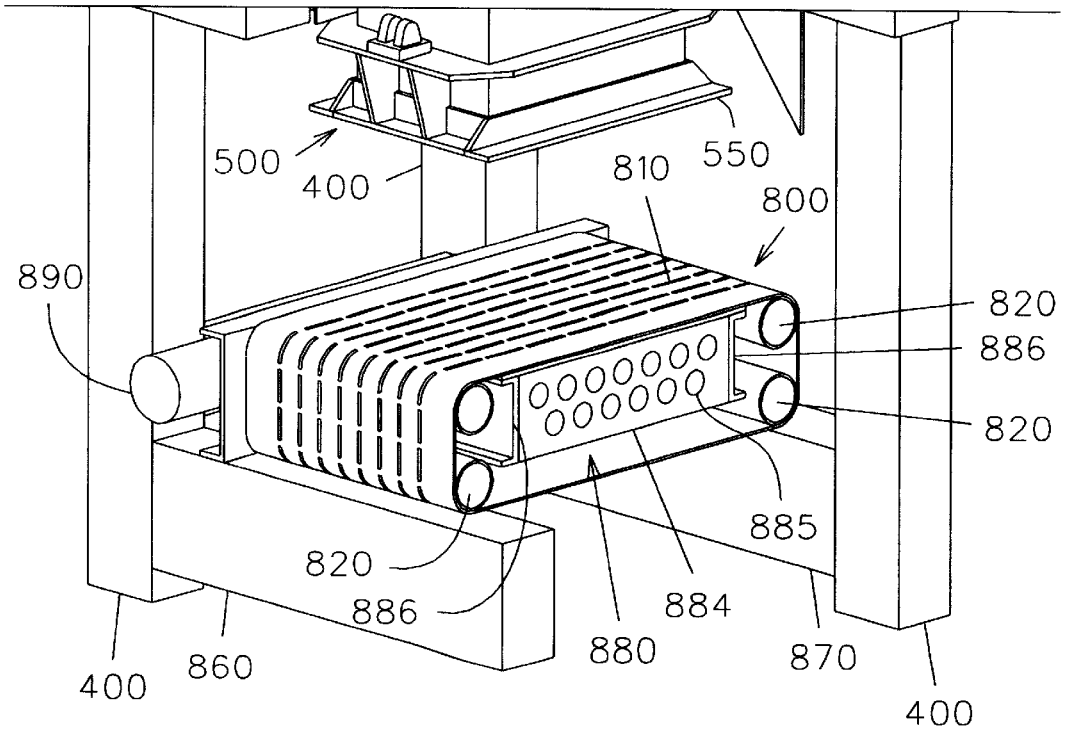
FIG. 7 is a fragmentary view as in FIG. 6 with an outer wall of the conveyor assembly framework removed.
Figure 8:
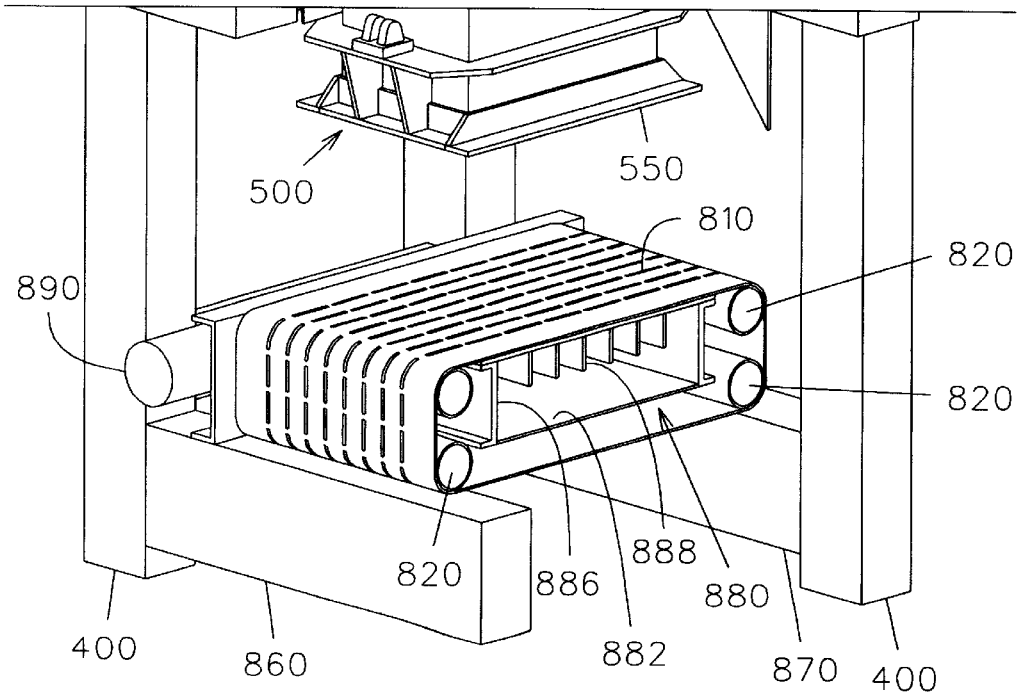
FIG. 8 is a fragmentary view as in FIG. 7 with a side wall of the air chamber removed.

As particularly shown in FIGS. 6–8, a first conveyor assembly 800 is located below the lower end of the tower 300, the first conveyor assembly 800 including a perforated conveyor belt 810 extending about rollers 820 between rails 830, 840. The first conveyor assembly 800 is supported by lower cross struts 860, 870. The first conveyor assembly 800 includes an air chamber 880 having a bottom wall 882 with upstanding side 884 and end walls 886. Within the air chamber 880, a series of vertical plates 888 underlie the conveyor belt 810. The side walls 884 and rails 830, 840 include a plurality of apertures 885, 850, respectively, such that air may be evacuated therefrom. Each rail 830, 840 is connected to the first blower 270 with conduit 890, an operation of which evacuates air from the air chamber 880 and from the compression chamber 500 when the chamber 500 is in its second extended position, as to be further described later.

The system 10 further includes a recompression apparatus 895 having a framework. The framework includes vertical legs 896 with side cross struts 897 extending therebetween. The framework also includes end struts 898 extending between the legs 896 for added stability. The recompression apparatus 895 includes a second conveyor assembly 900 horizontally adjacent the first conveyor assembly 800 and mounted to the framework. A third conveyor assembly 920 is pivotally mounted to the framework with pillow block bearings 922 and spaced above the second conveyor assembly 900. The space between the second 900 and third 920 conveyor assemblies is manually adjustable by sliding an upper frame 899 supporting the third conveyor assembly 920 vertically along guide members 899' supported on the upper portions of the legs 896.

Figure 15:
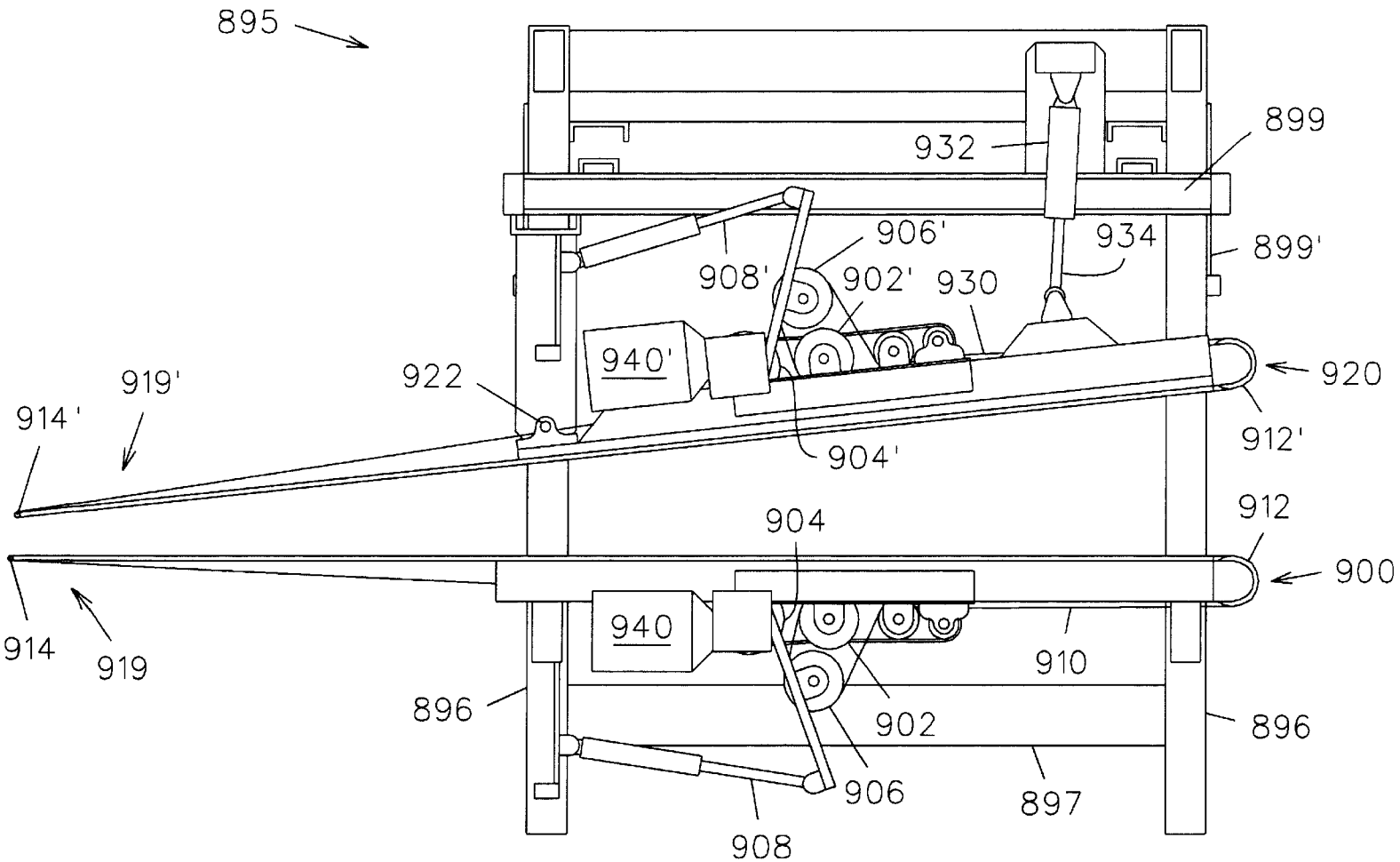
FIG. 15 is a side view of the apparatus of FIG. 13 with a pair of legs removed and with the second conveyor assembly in a second position.
Figure 16:
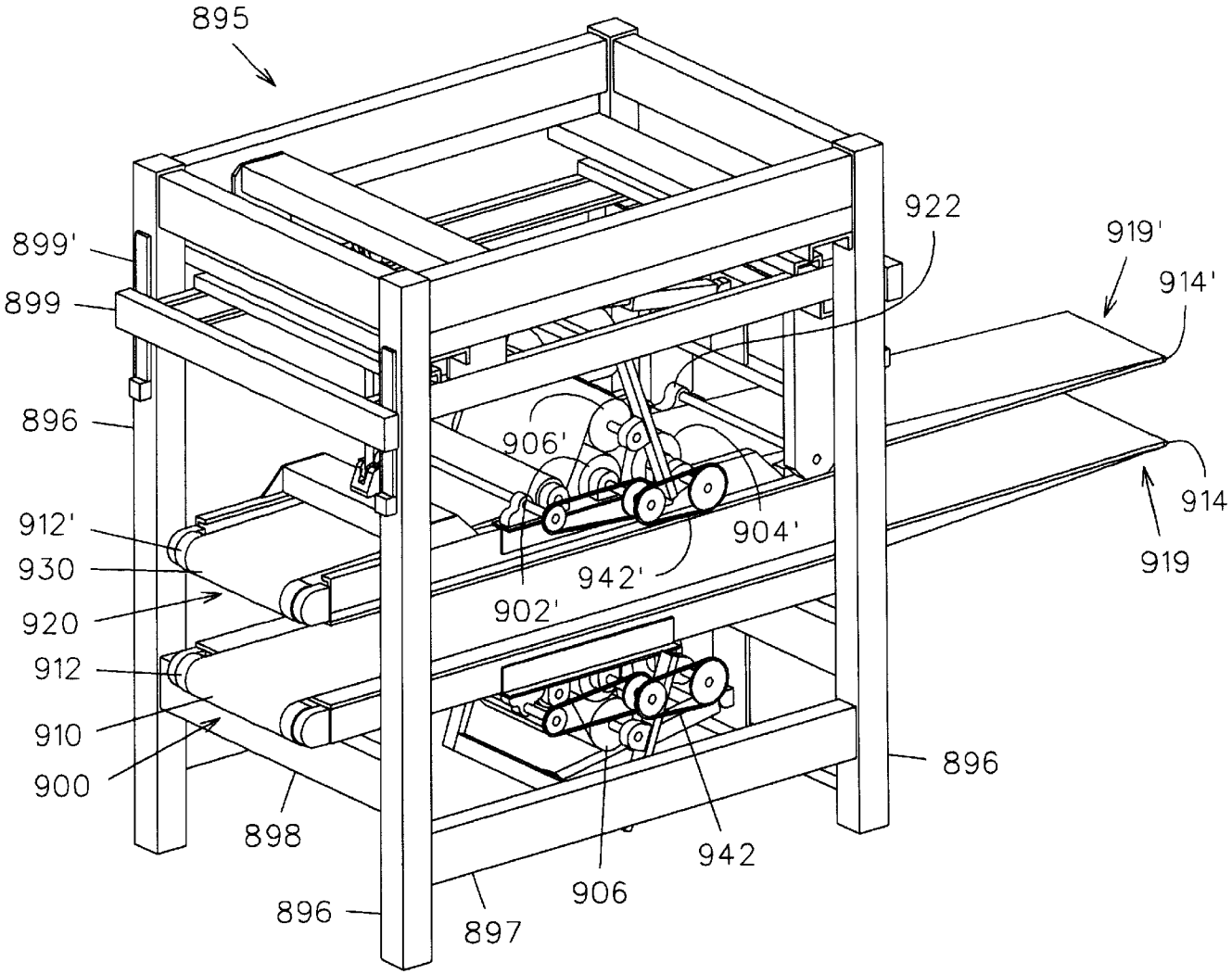
FIG. 16 is a rear perspective view of the apparatus of FIG. 13.
Figure 17:
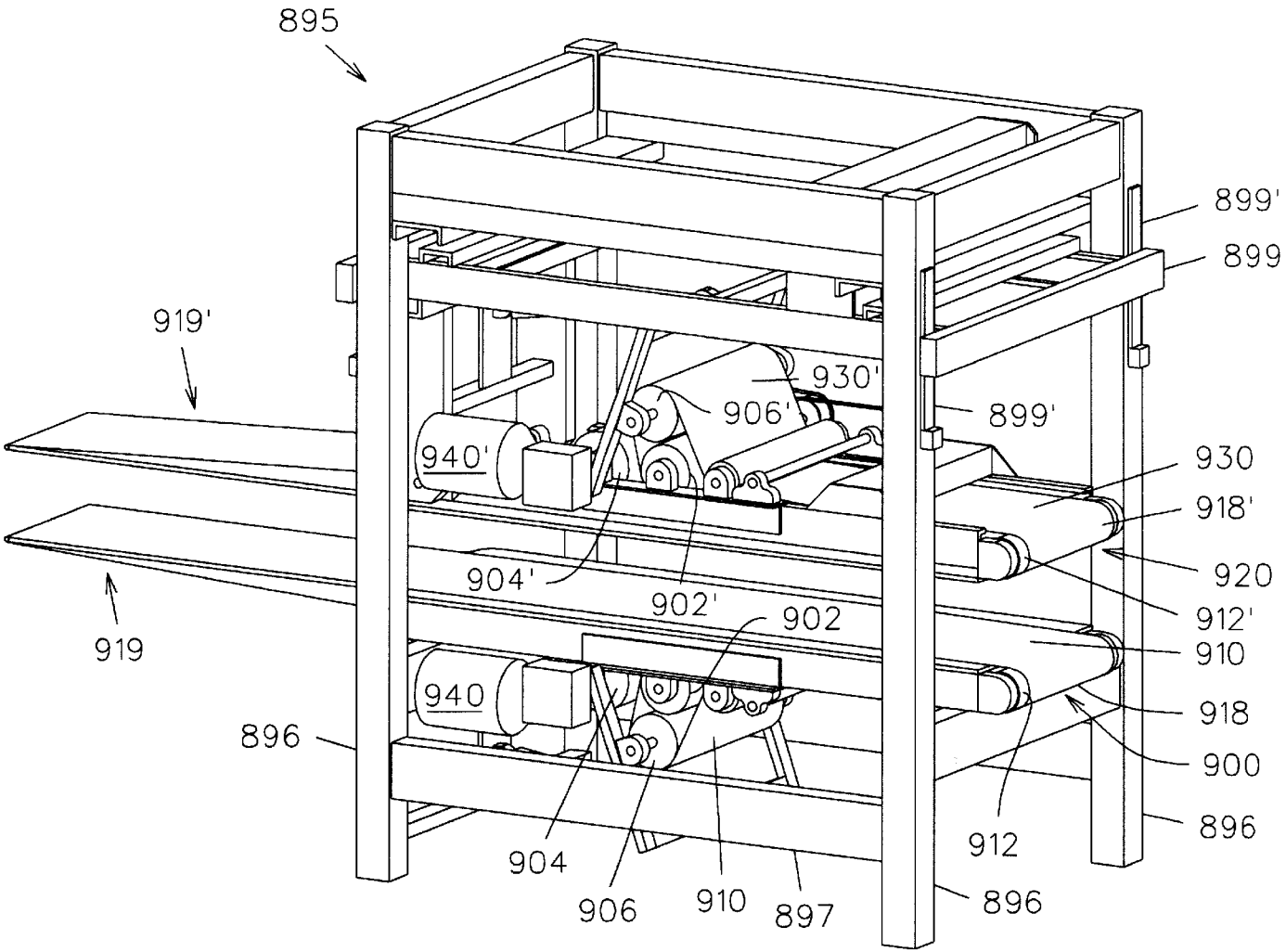
FIG. 17 is another perspective view of the downstream conveyance apparatus.

As shown in FIGS. 15 and 16, the second conveyor assembly 900 includes first 902 and second 904 rollers pivotally mounted to the bottom side thereof. The second conveyor assembly 900 includes a conveyor belt 910 having a first end coupled to the first roller 902 and a second end coupled to the second roller 904. An idler roller 906 is coupled to an idler arm 908 which in turn is coupled to the framework and operates conventionally to maintain the proper conveyor belt tension. The second conveyor assembly also includes first 912 and second 914 guide rollers pivotally coupled to upstream 918 and downstream 919 ends thereof. It should be appreciated that the second guide roller 914 presents a small diameter which enhances efficient and accurate conveyor belt tracking.

The first 902 and second 904 rollers are coupled to a motor 940 with a drive chain assembly 942 for simultaneous operation thereof (FIG. 16). In a first position, the conveyor belt 910 is wound about the first roller 902 and extends about the first guide roller 912, the second conveyor surface, and the second guide roller 914, with the second end of the belt being coupled to the second roller 904. An operation of the rollers 902, 904 in a first downstream direction moves the belt 910 in a downstream direction along the second conveyor surface, e.g. for downstream conveyance of a material bulk. This movement results in the belt 910 unreeling from the first roller 902 and being wound about the second roller 904. An operation of rollers 902, 904 in the opposite or upstream direction resets the belt 910 to the first position. It should be appreciated that use of non-continuous conveyor belts minimizes, if not precludes, the tracking problems common to continuous belt conveyor assemblies without the need for expensive tracking systems.

The third conveyor assembly 920 includes a construction substantially similar to that of the second conveyor assembly 900 and thus primed numbers are shown in the drawings relative to like elements. The third conveyor assembly 920, however, is pivotally mounted to the framework, a pivot axis being established at the pillow block bearings 922. A piston/cylinder combination 932 is pivotally attached to the framework and includes a reciprocatively movable rod 934 coupled to the upstream end 918' of the third conveyor assembly 920. Movement of the rod 934 causes the third conveyor assembly 920 to pivot as a material bulk is conveyed downstream such that the downstream ends 919, 919' again compress the material bulk (FIG. 15).

It is understood that conveyor belt assembly 800 is powered in a conventional manner and conveyor assemblies 900, 920 are powered as described above so as to convey and transfer materials therebetween. It is also understood that the extensions and retractions of the above described piston/cylinder combinations 570, 620, 932 are also controlled in a conventional manner.

Figure 9:
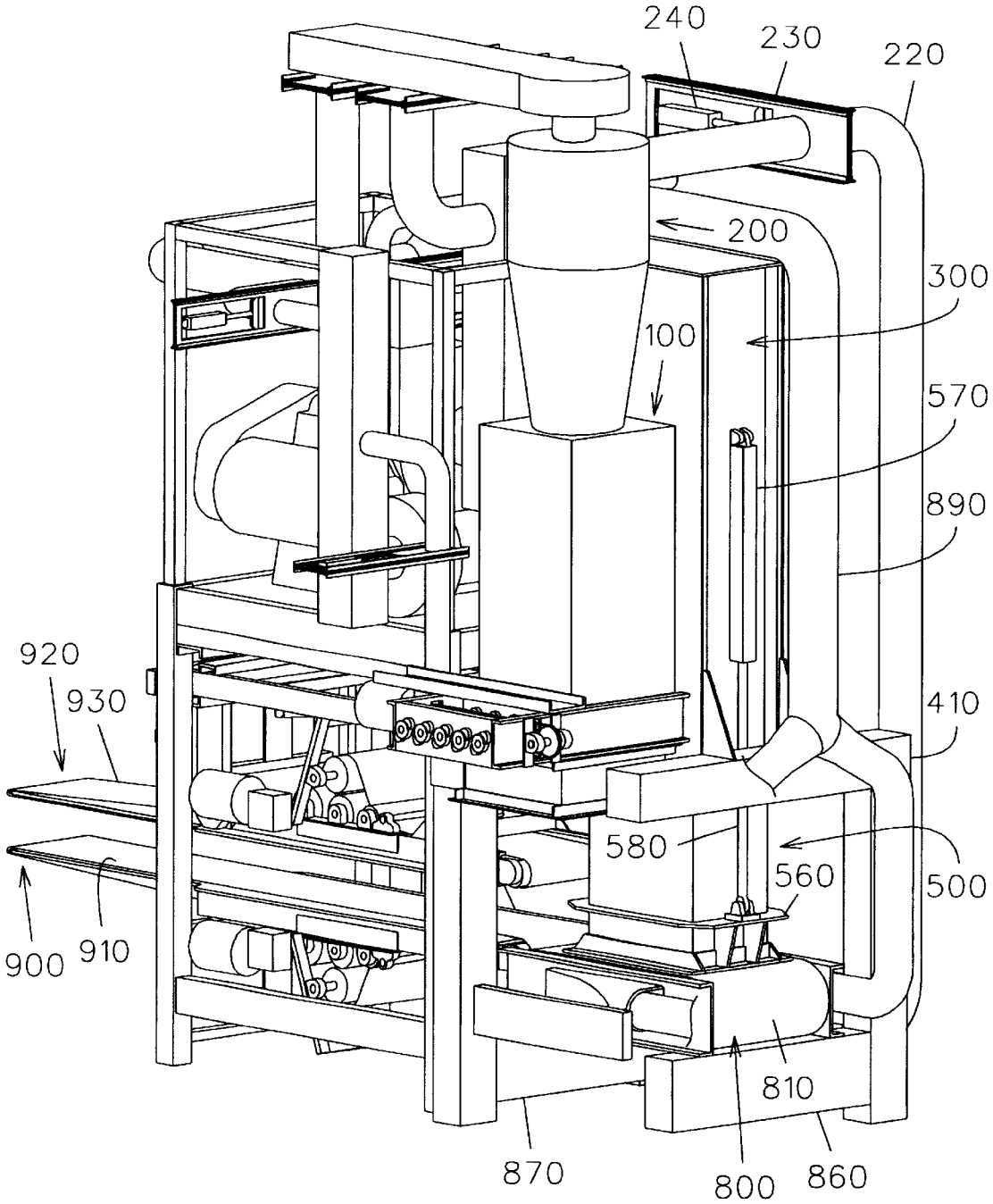
FIG. 9 is a front perspective view as in FIG. 1 with the compression chamber in an extended position.

In operation, the compression chamber 500 is positioned in its first retracted position wherein the chamber 500 is displaced from the first conveyor assembly 800. An operation of the first blower 270 causes air to be evacuated from the chamber 500 and loose particulate material to be drawn from the surge bin 260 into the cyclone 200. An operation of the second blower 140 then draws the particulate material into the feed hopper 100 by removing air therefrom. The chamber 500 is then reciprocatively lowered such that the lower end thereof contacts the conveyor belt 810 of the first conveyor assembly 800 (FIG. 9). With the gate 230 to the upstream portion 220 of the conduit between the cyclone 200 and surge bin 260 in a closed position, an operation of the first blower 270 draws the particulate material from the hopper 100 into the compression chamber 500 through the hopper outlet, tower inlet, and chamber inlet 512 and onto the perforated conveyor belt 810 of the first conveyor assembly 800. The inlets are in registration when the tower 300 is in its lowered position and the chamber 500 is in its raised position, as shown in FIG. 4. It should be appreciated, however, that particulate material may be transferred into the chamber 500 without the use of vacuum air pressure (e.g. with conveyor assemblies, etc.).

Figure 10:
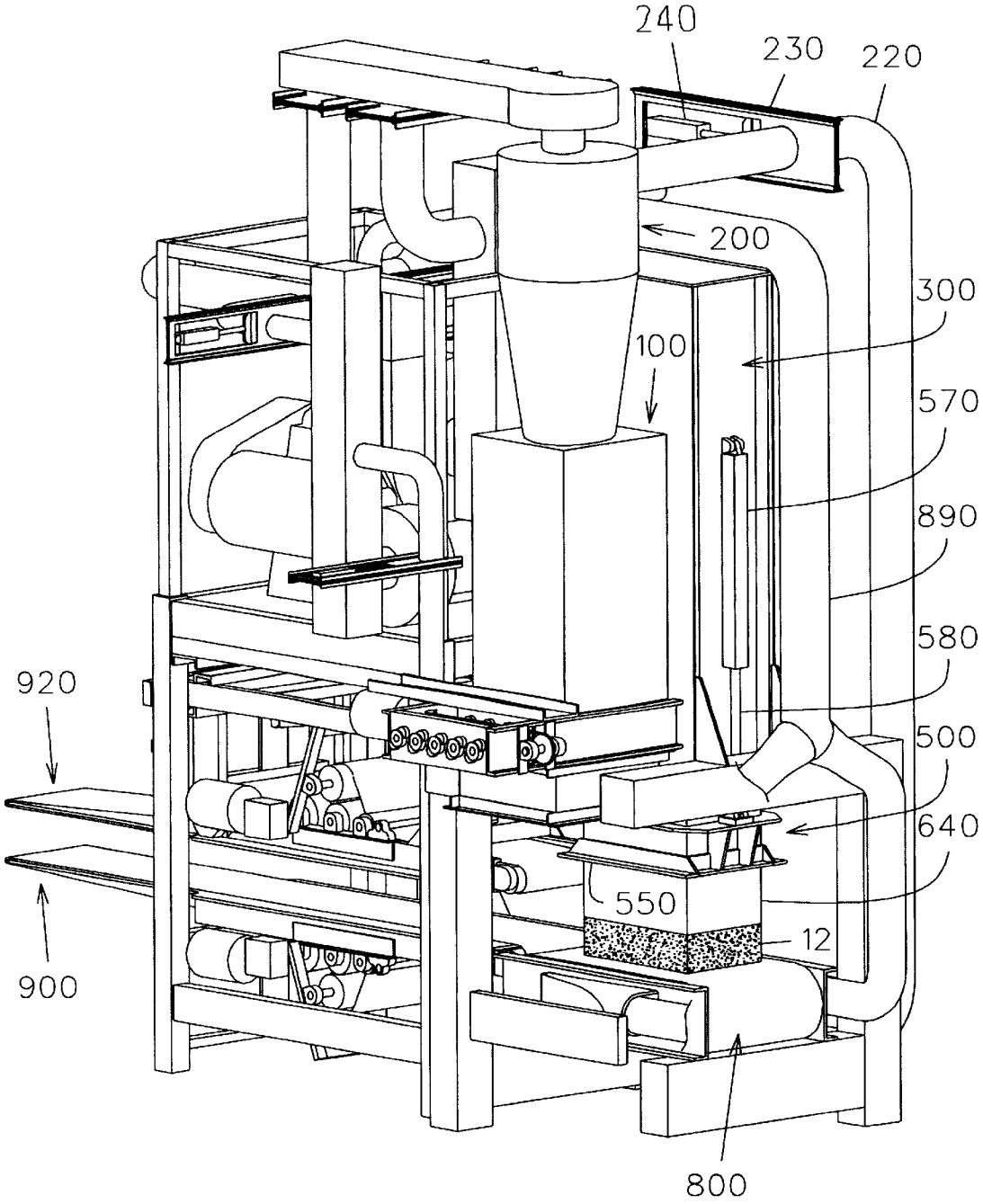
FIG. 10 is a front perspective view as in FIG. 9 with the compression chamber in a retracted position and the ram assembly in an extended position.
Figure 11:
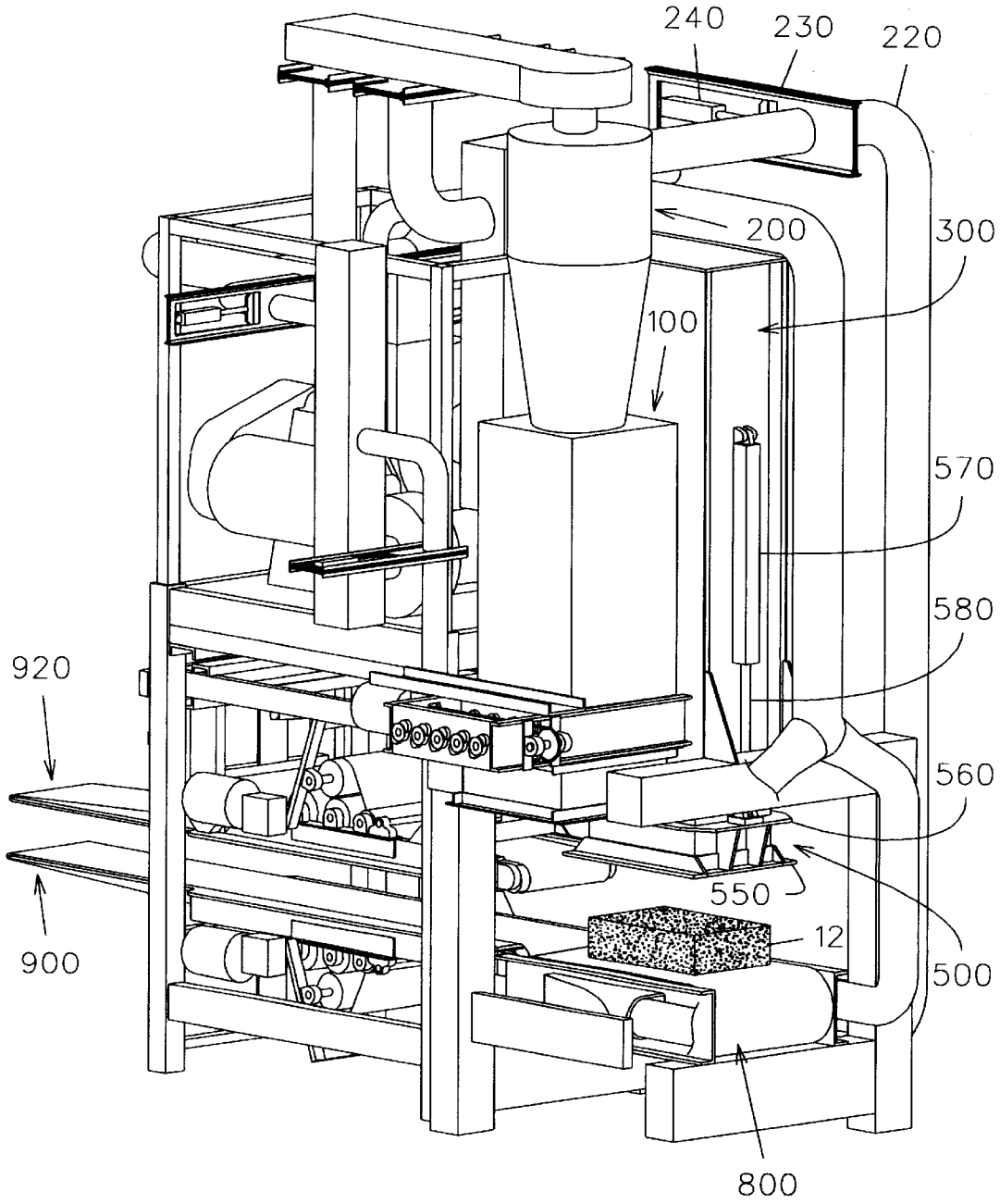
FIG. 11 is a front perspective view with the compression chamber in a retracted position and a material bulk on the conveyor surface.

As air is evacuated from the chamber through the first conveyor assembly 800, the particulate material is compressed atop the conveyor belt 810. The ram assembly 600 is then positioned in its extended position to further compress the particulate material into bulk form 12. Following formation of the material bulk 12, the chamber 500 is retracted to its first position and positive air pressure is introduced into the chamber 500 from the fourth blower 720 (FIG. 10). This positive air pressure assists the compression assembly 640 in separating from the material bulk 12 without dislodging material therefrom (FIG. 11).

An operation of the first conveyor assembly 800 transfers the material bulk 12 to the second conveyor assembly 900. In a first position (FIG. 14), the third conveyor assembly 920 is spaced above the second conveyor assembly 900 and above the material bulk (not shown). Thus, the material bulk is conveyed downstream by a downstream operation of the conveyor belt 910 of the second conveyor assembly 900. After a predetermined time, however, the third conveyor assembly 920 is pivoted by a movement of the rod 934 such that downstream ends 919, 919' of the second 900 and third 920 conveyor assemblies bear against the material bulk, whereby to again compress the bulk prior to packaging thereof (FIG. 15). It is understood that the material bulk may then be conveyed into a bag or further to a packaging station. The conveyor belts 910, 930 are then returned to their first position by upstream operations of the respective motors.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A system for forming and packaging particulate material in a bulk form, comprising:

a compression tower defined by a series of walls, said tower including an opening at a lower end thereof;

a first conveyor having a first conveyor surface displaced from said lower end of said tower;

a chamber in said tower having openings at upper and lower ends thereof, said chamber selectably movable between a first chamber position wherein said lower end of said chamber is displaced from said conveyor surface and a second chamber position wherein said lower end of said chamber is adjacent said first conveyor surface, whereby said opening at said lower end of said chamber is closed when said chamber is at said second chamber position;

a ram assembly in said chamber having a first ram position adjacent said upper end of said chamber and selectably extendable to a second ram position adjacent said lower end of said chamber when said chamber is at said second chamber position;

an inlet in said tower;

an inlet in said chamber registering with said tower inlet when said chamber is at said second chamber position and said ram assembly is at said first ram position;

vacuum means for transferring particulate material through said tower and chamber inlets when said chamber is at said second chamber position and said ram assembly is at said first ram position, said particulate matter falling on said first conveyor surface, said vacuum means evacuating air from said chamber for compressing said particulate material into a bulk form atop said first conveyor surface, an extension of said ram to said second ram position further compressing said material into a bulk form atop said first conveyor surface, said first conveyor surface including a first conveyor belt for moving the bulk form downstream of said tower;

a downstream apparatus having a framework and including:

a second conveyor mounted to said framework and having upstream and downstream ends, said second conveyor presenting a second conveyor surface for supporting a compressed bulk form;

a third conveyor pivotally mounted to said framework and having upstream and downstream ends and a third conveyor surface, said third conveyor movable between a first position parallel to said second conveyor and vertically spaced from the compressed bulk form and a second position in which a vertical space between said downstream ends is smaller than a vertical space therebetween at said first position; and means for moving said third conveyor between said first and second positions as the bulk form is conveyed downstream, whereby to again compress the bulk form on said second conveyor surface.

2. A system as in claim 1 wherein said moving means comprises:

a piston/cylinder assembly including respective ends attached to said framework and said third conveyor, a movement of said piston/cylinder pivotally moving said third conveyor between said first and second positions relative to said second conveyor.

3. A system as in claim 1 further comprising means for mounting said third conveyor to said framework at a selectable vertical position, whereby to compress the bulk form to a desired height.

4. A system as in claim 1 further comprising:

first and second rollers pivotally coupled to said second conveyor;

a second conveyor belt having a first end coupled to said first roller and a second end coupled to said second roller, an operation of said first and second rollers moving said second conveyor belt in downstream or upstream directions along said second conveyor surface;

third and fourth rollers pivotally coupled to said third conveyor; and a third conveyor belt having a first end coupled to said third roller and a second end coupled to said fourth roller, an operation of said third and fourth rollers moving said third conveyor belt in downstream or upstream directions along said third conveyor surface.

5. A system as in claim 4 further comprising:

a first guide roller pivotally coupled to said upstream end of said second conveyor and a second guide roller pivotally coupled to said downstream end of said second conveyor, said second guide roller having a diameter smaller than a diameter of said first guide roller for enhancing a tracking of said second conveyor belt at said downstream end of said second conveyor; and a third guide roller pivotally coupled to said upstream end of said third conveyor and a fourth guide roller pivotally coupled to said downstream end of said third conveyor, said fourth guide roller having a diameter smaller than a diameter of said third guide roller for enhancing a tracking of said third conveyor belt at said downstream end of said third conveyor.

* * * * *